US010036603B2

(12) United States Patent
Maranli

(10) Patent No.: US 10,036,603 B2
(45) Date of Patent: Jul. 31, 2018

(54) GAS APPARATUS AND METHODS FOR GAS OPERATED FIREARMS

(71) Applicant: Maranli Automation, Inc., Mt. Orab, OH (US)

(72) Inventor: Hasan Maranli, Sardinia, OH (US)

(73) Assignee: Maranli Automation, Inc., Mt. Orab, OH (US)

( * ) Notice: Subject to any disclaimer, the term of this patent is extended or adjusted under 35 U.S.C. 154(b) by 0 days.

(21) Appl. No.: 14/919,043

(22) Filed: Oct. 21, 2015

(65) Prior Publication Data

US 2017/0115081 A1 Apr. 27, 2017

(51) Int. Cl.
*F41A 5/24* (2006.01)
*F41A 21/48* (2006.01)
*F41A 5/26* (2006.01)

(52) U.S. Cl.
CPC ..... *F41A 5/24* (2013.01); *F41A 21/485* (2013.01); *F41A 5/26* (2013.01)

(58) Field of Classification Search
CPC .. F41A 21/484; F41A 5/18; F41A 5/20; F41A 5/24; F41A 5/26; F41A 5/28; F41C 7/00
USPC ..... 89/125, 193, 191.02
See application file for complete search history.

(56) References Cited

U.S. PATENT DOCUMENTS 3,174,401 A * 3/1965 Beretta ..... F41A 5/18 89/192
3,382,766 A * 5/1968 Seiderman ..... F41A 5/18 89/193
4,056,038 A * 11/1977 Rath ..... F41A 5/18 42/16
4,322,999 A * 4/1982 Aston ..... F41A 21/36 89/14.3
7,523,580 B1 * 4/2009 Tankersley ..... F41C 23/16 42/71.01
8,640,598 B1 * 2/2014 Jackson ..... F41A 5/20 89/191.01
2006/0260169 A1 11/2006 Samson et al.
2011/0277623 A1 * 11/2011 Adolphsen ..... F41A 5/06 89/193
2012/0036756 A1 * 2/2012 Brown ..... F41A 3/66 42/71.01

(Continued)

FOREIGN PATENT DOCUMENTS

DE 3501516 A1 * 7/1986 ..... F41A 5/26
DE 3501516 A1 7/1986

(Continued)

OTHER PUBLICATIONS

International Searching Authority, Search Report and Written Opinion Issued in Corresponding International Application No. PCT/US2016/055243 dated Jun. 6, 2017, 14 pages.

*Primary Examiner* — John Cooper
(74) *Attorney, Agent, or Firm* — Wood Herron & Evans LLP

(57) ABSTRACT

A gas operated firearm includes a barrel with an integrally formed gas block as one piece with the barrel. A barrel nut is assembled over the integral barrel and gas block, securing the rear barrel end to a firearm receiver. Gas tube or piston assembly and field replacement are enhanced, along with accommodation of increased size barrels and integral muzzle end devices, no longer limited by internal dimensions of separately added gas blocks.

14 Claims, 7 Drawing Sheets

(56) References Cited

U.S. PATENT DOCUMENTS

| | | | | |
|---|---|---|---|---|
| 2013/0098235 | A1* | 4/2013 | Reinken | F41A 5/28<br>89/193 |
| 2014/0305297 | A1* | 10/2014 | Hall | F41A 5/26<br>89/193 |
| 2014/0352191 | A1* | 12/2014 | Fritz | F41A 5/18<br>42/75.03 |
| 2015/0184960 | A1* | 7/2015 | Monveldt | F41A 5/26<br>89/193 |
| 2015/0330729 | A1* | 11/2015 | Adolphsen | F41A 5/20<br>89/193 |

FOREIGN PATENT DOCUMENTS

| | | | | | |
|---|---|---|---|---|---|
| DE | 3510366 | A1 | | 9/1986 | |
| EP | 2693156 | A2 | | 2/2014 | |
| GB | 500621 | A | | 2/1939 | |
| GB | 825226 | A | * | 12/1959 | B25C 1/12 |
| GB | 825226 | A | * | 12/1959 | B25C 1/12 |

* cited by examiner

GAS APPARATUS AND METHODS FOR GAS OPERATED FIREARMS

FIELD OF THE INVENTION

This invention relates to fire control apparatus and methods for gas operated firearms and particularly to improved apparatus and methods in and for firearm platforms such as the gas operated AR-15, AR-10, M-16, firearms platforms and including light, medium, or heavy machine guns and other gas operated firearms. Gas operated firearms are of both the direct gas impingement type of the gas driven piston type.

BACKGROUND OF THE INVENTION

Typically, gas operated firearms of the AR-15, AR-10 or M-16 platforms or the like include a receiver, a barrel, a bolt carried by a bolt carrier in the receiver and a "gas block" mounted on the barrel. The barrel is ported to the gas block and in one form of gas operated firearm, a gas tube extends rearwardly from the gas block toward the receiver and the bolt carrier. Gas pressure exits from the tube for operating the firearm through the transmission of a gas impulse, from the combustion of the cartridge, to the bolt carrier to cycle it and the bolt. In another form of a gas operated firearm, known as the "piston" gun, gas pressure ported from the barrel drives a rearwardly extending piston which engages the bolt carrier to cycle the firearm. In these firearm platforms the barrel is secured to the receiver by a barrel nut engaging a barrel flange and threaded to the receiver. In typical production, after the gas block is installed on the secured barrel, then a muzzle brake, flash hider or other barrel end device is typically mounted onto the muzzle end of the barrel. The outer parameters of these items do not permit installation of the barrel nut after these items are installed.

This system inherently presents several disadvantages adversely affecting the firearm, its reliability, its repair, and its assembly process.

Significantly it will be appreciated that any misalignment of the gas block on the barrel, for any reason, as in original assembly or in later repair or rugged field use can cause the weapon to fail.

As in one example, in assembling the firearm, the barrel is first fitted to the receiver and secured thereon by the threaded barrel nut which is passed over the barrel. The gas tube, gas block, any front sight and any barrel end device is then assembled with the front end of the gas tube being pinned into the gas block. Typically the gas block is pinned in position on the barrel. The structure and outside dimensions of the gas block in particular requires the barrel nut to be applied over the barrel before the gas block or the other components, such as any muzzle end device like a flash hider or muzzle brake, are fitted to the barrel. The internal diameter of the barrel nut is insufficient to allow the nut to be passed over the barrel and over the typically bulky gas block or muzzle end devices.

Alignment of the gas port of the barrel with the gas-receiving port of the gas block is thus problematical and must be done after the barrel nut is passed to the rear end of the barrel to secure it to the threaded receiver. This typically requires assembly fixtures for the receiver and/or barrel. Also any sight fixture and any muzzle end device must be fitted to the barrel after the barrel nut passage and for the same reason, particularly if the outside dimensions of the device exceeds the internal dimension of the barrel nut. The gas or gas tube or gas block, positioning pin is typically driven into the gas block, tending to torque the barrel, requiring compensation of that force.

Thus the typical requirement of fitting the barrel nut over the barrel before assembly of the gas block and gas tube and any muzzle end device leads to necessary assembly procedures.

This structure and associated assembly process inherently conflicts with related processes including, for example, any attempted field replacement of a defective or damaged gas tube. If a gas tube leaks or is damaged so as to interfere with firearm function, it must be replaced. In the past, this requires the gas block pin engaging the gas tube, and/or the block positioning pin, to be driven out of the gas block. Such pin removal forces torque or tend to turn the barrel, the gas block and the receiver of the firearm. This typically requires one or more fixtures holding the barrel, gas block, and/or receiver, as well as a barrel nut wrench to hold the nut. And once the positioning pin and gas tube is removed, if the barrel nut is loosened, a wrench must be used to re-torque and align the nut with a new tube. Again, the barrel must be held while the gas tube is oriented so that its parts align with the barrel parts and while the new tube is positioned and held in the gas block by driving a new pin therein.

These mechanizations render the replacement of a gas tube more complicated than is field expedient.

In addition to the original assembly process of aligning the gas block ports with the barrel ports, after the barrel nut passage, it is only after application of the barrel nut down the barrel that muzzle-end devices, having outside dimensions exceeding the internal dimensions of the nut, can be affixed to the barrel.

Also, it will be appreciated that the prior assembly process limits the outside diameter of the barrel forward of the gas block to dimensions not exceeding those of the interior of the gas block, which must be slid over the barrel after the barrel nut is applied.

It is thus apparent that the limited internal diameter of the barrel nut forces a particular assembly sequence, severely limiting the gas block, tube, muzzle device and other structural components and assembly techniques, as well as field expedient gas tube replacement.

Accordingly, it is an objective of this invention to provide an improved gas system and barrel structure for a gas operated firearm of either the direct gas impingement type of the gas driven piston type and without the prior limitations demanded by the barrel nut and the barrel components as noted.

It is a further objective of the invention to eliminate alignment problems between the gas block and barrel of a gas-operated firearm.

It is a further objective of the invention to provide a gas operated weapon wherein an integral barrel, gas block and optional muzzle device can be assembled to the receiver prior to the assembly of barrel nut thereto.

It is a further objective of the invention to provide field expedient processes and structure for gas tube replacement in a gas-oriented firearm.

It is yet a further objective of the invention to provide improved apparatus, structure and related methods for a gas operated firearm.

SUMMARY OF THE INVENTION

To these ends the invention contemplates, in a preferred embodiment, a barrel for a gas operated firearm wherein a gas block is formed integrally with the barrel, all as one piece. With an integrally formed gas block as an integral, monolithic component of the barrel, the gas block dimensions can be substantially reduced as compared to traditional, prior separate gas blocks. The gas tube or piston receiving bore in the gas block is more closely oriented to the adjacent barrel surface so the overall outer dimensions of the integral gas block are minimal.

A barrel nut for holding the barrel to a firearm receiver has an inner dimension operatively larger than the outer dimensions of the integral gas block. In this fashion, the barrel nut can be applied along the barrel to its rear end and over the integral gas block; its application thus is not required to precede gas block assembly and alignment.

As well, a muzzle-end device such as a flash hider or muzzle brake can be integrally formed as part of the barrel. The outside dimension of such a device being within the internal clearances of the barrel nut, which can slide thereover.

Thus the entire barrel and integral gas block, together with an integral muzzle device all can be positioned for assembly to the receiver before the barrel nut is moved along and positioned on the barrel. In this manner, the barrel with barrel nut is positioned on the receiver. The gas tube is then applied by extending into the receiver, then outwardly into the bore of the gas block where it is secured by a threaded pin screwed transversely through the block and through a transverse bore in the tube end, oriented transversely to the tube bore. This accurately aligns a port in the tube with the port through the integral gas block to the barrel port. And being threaded, no barrel-torquing pin driving force is necessary for tube or gas block securement. Alternately, a piston is inserted into the gas block bore.

Another gas block bore extends from the barrel through the block and is aligned onto a barrel-facing bore or opening in the tube for gas passage to the receiver and by the gas tube positioning pin.

In addition and alternatively, a screw is inserted through the block and the tube with a valve end adjustably seated in the gas block or barrel part for adjustment of the gas passage and operational energy for cycling the firearm.

Advantages of the invention are readily apparent. Gas block and muzzle devices can be formed integrally with the barrel, eliminating separate manufacture, separate assembly, separate alignment of the block on the barrel, and torquing of the barrel by any block pin driving force.

Significantly, field replacement of a defective gas tube or piston is much simplified and quicker. Once exposed by any forearm or hand guard, any gas tube retaining screw through the gas block is removed, the tube slid rearwardly to clear the block, then pulled forwardly and discarded. A replacement tube is inserted into the receiver, pulled forwardly so its forward end is inserted into the gas block, then rotated if necessary. The tube positioning pin is screwed in and the replacement thus completed in seconds, and without any armorer's tool or fixtures other than an allen wrench for the screw. Such assembly automatically aligns the tube passages and ports with the gas bore in the integral gas block.

Alternately, a piston rod is removed and a new rod is similarly positioned but without any gas tube positioning pin.

These and other objectives and advantages will become readily apparent from the following written description of the invention and from the drawings in which:

DETAILED DESCRIPTION OF THE INVENTION

Figure 1:
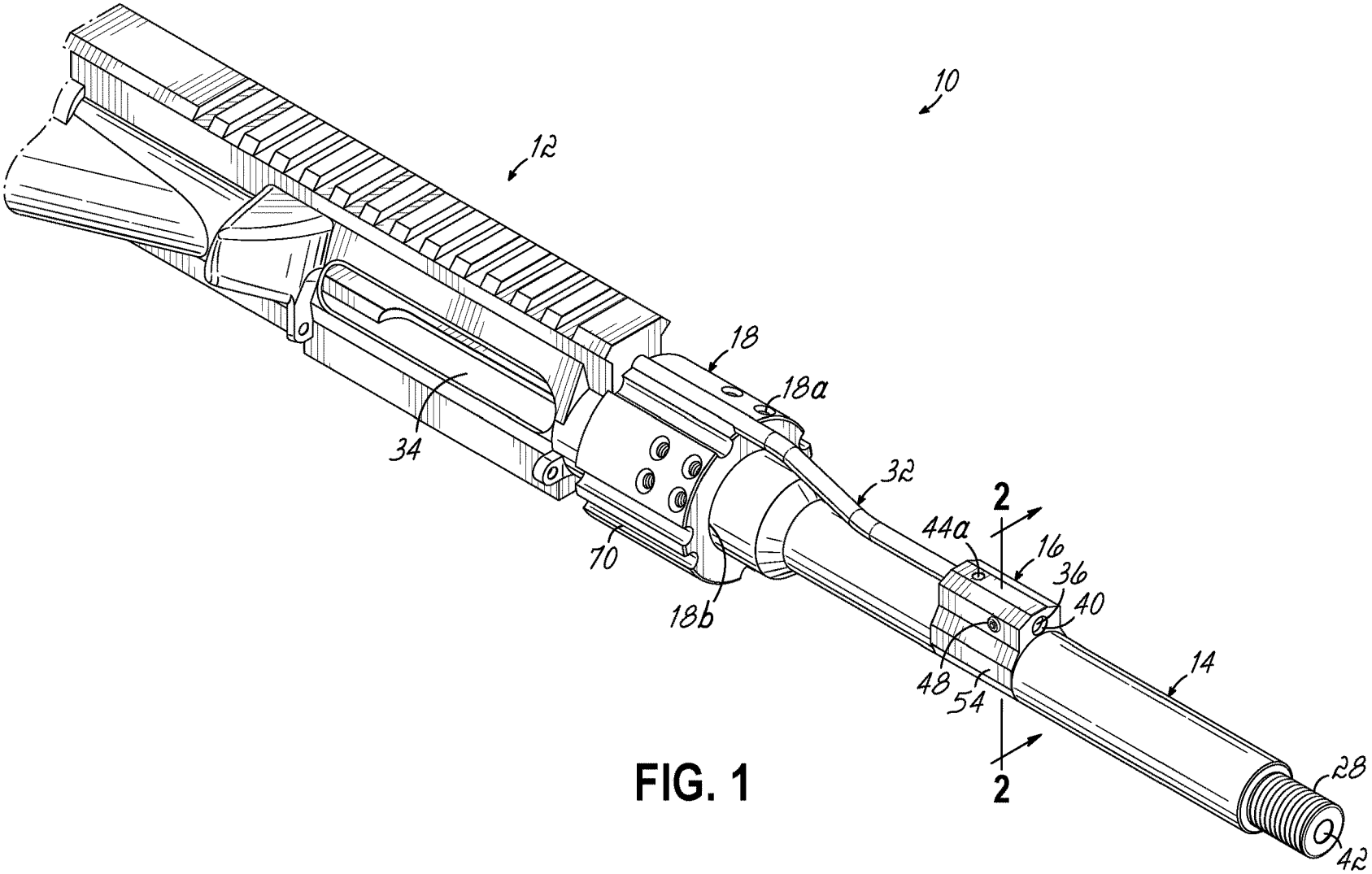
FIG. 1 is an isometric view of the invention in assembled form in a firearm.

Turning now to the drawings, the invention shown in the Figs. is directed to the direct gas impingment firearm using a gas tube. This embodiment is illustrated in FIG. 1. A firearm 10, such as an AR-15, AR-10 or other similar platform is shown. Firearm 10 includes a traditional upper receiver 12 (shown with a mil. spec. picatinny rail), and, according to the invention, a barrel 14 provided with an integral gas block 16 formed monolithically with and as an integral part of barrel 14. Thus, according to the invention, barrel 14 and gas block 16 consist of a single part. Gas block 16, being an integral part of barrel 14, does not require the extra thickness for strength as would a separate add-on gas block. As compared to the prior art, gas block 16 is of significantly reduced, radially extending size.

Figure 8:
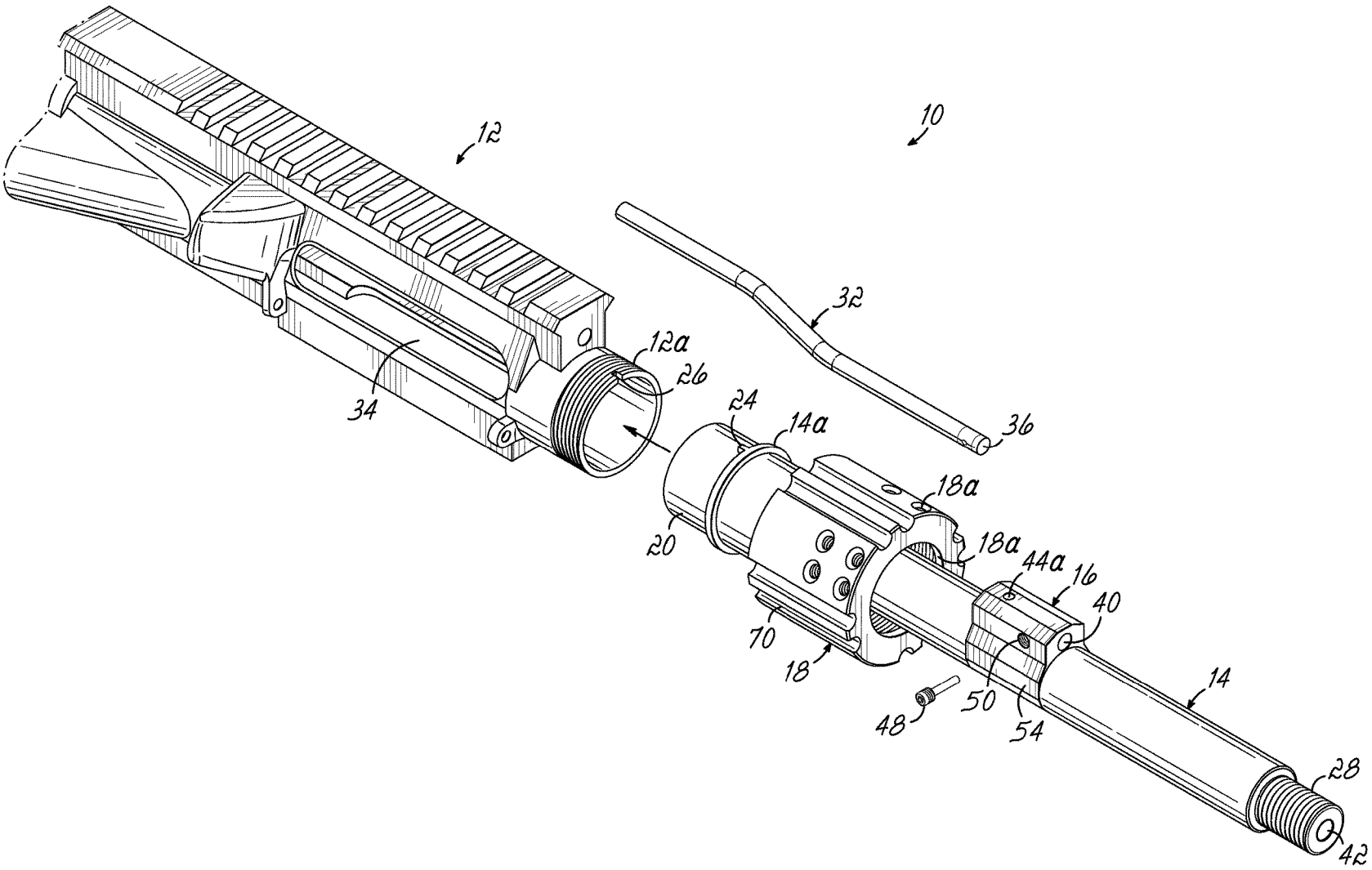
FIG. 8 is an isometric view of the invention of FIG. 1 in disassembled form.
Figure 9:
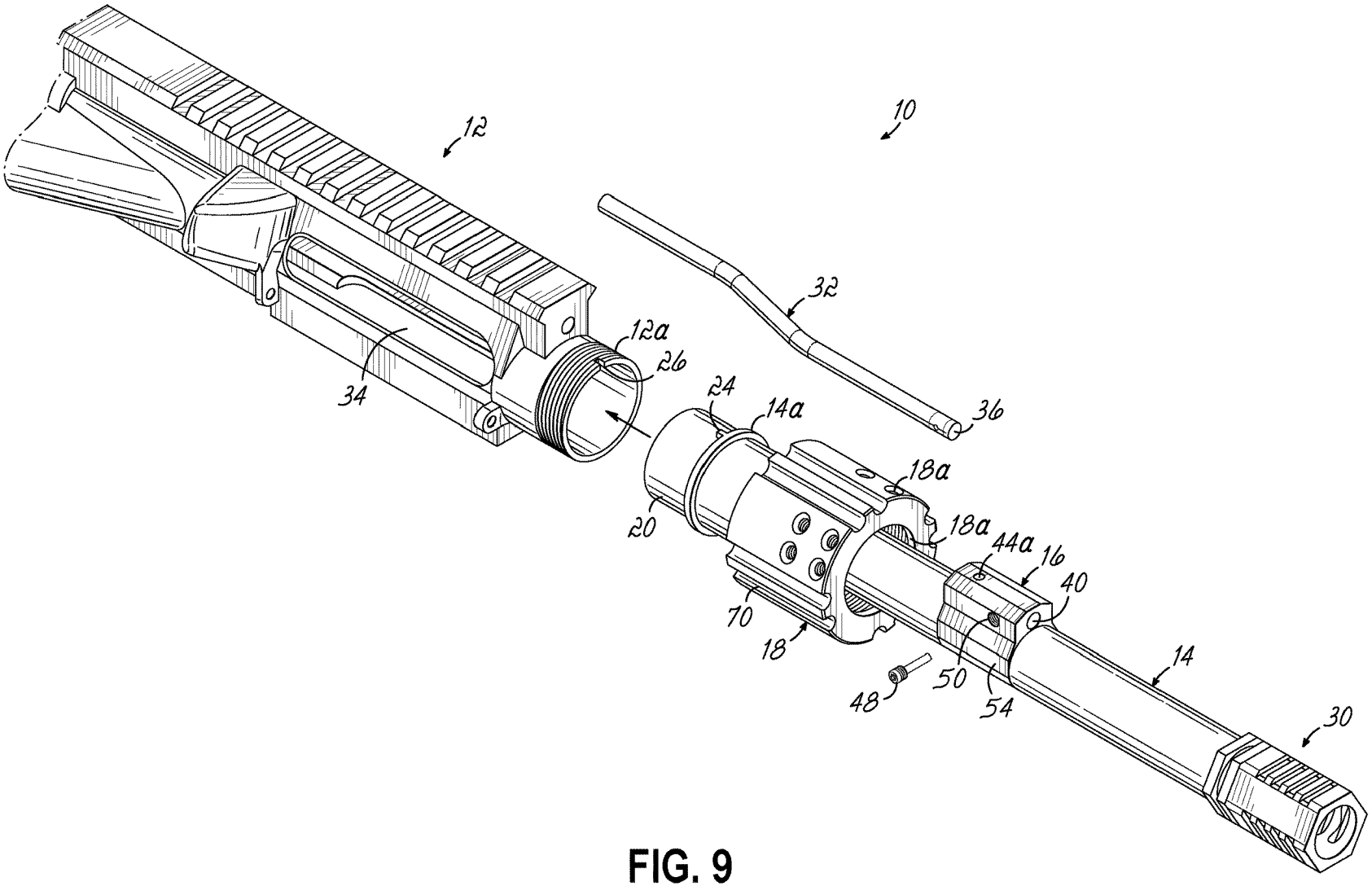
FIG. 9 is an isometric view of the invention in FIG. 1 in disassembled form and showing an integral muzzle device on the end of the barrel with an integral gas block.

A barrel nut 18 is internally threaded (not shown) for operative engagement with receiver 12 at externally threaded receiver extension 12*a*, to secure barrel 14 thereon, via flange 14*a*. This cooperation is best illustrated in FIGS. 8 and 9 where barrel 14 has a rearwardly directed extension ring 20, provided with a retaining flange 14*a* and an extension ring pin 24. Where barrel 14 and receiver 12 are fitted together, pin 24 fits into slot 26 in receiver extension 12*a* positions barrel 14 with respect to receiver 12 and prevents angular movement between barrel 14 and receiver 12.

Barrel nut 18 is provided with threaded holes 18*a* for attachment of components, such as hand guards or the like.

Preferably, barrel 14 has a threaded end 28 for a variety of muzzle devices or the barrel may be fitted with an integral muzzle device, such as a flash hider, brake or other muzzle device 30 (FIG. 9) as will be herein appreciated. Prior integral muzzle-end devices as well as barrels having enlarged outer diameters at their forward end are significantly limited by the internal diameters of the prior, separately filled gas blocks.

With further reference to FIGS. 1-7, firearm 10 is provided with a gas tube 32 extending from gas block 16 rearwardly into receiver 12. Gas transmitted into receiver 12 functions to cycle the bolt 34 of the firearm 10 in a well-known manner.

FIGS. 2-5, in a variety of views, illustrate structure of the invention at the area of the gas block 16 and forward end 36 of gas tube 32. In this regard, it will be appreciated that forward end 36 of tube 32 is blocked off as shown so the open interior gas passage 38 of tube 32 is closed off at end 36.

While the block 16 is herein referred to as integral with barrel 14, the combined integral barrel and gas block will also sometimes be referred to herein as the monobloc barrel for clarity.

Figure 2:
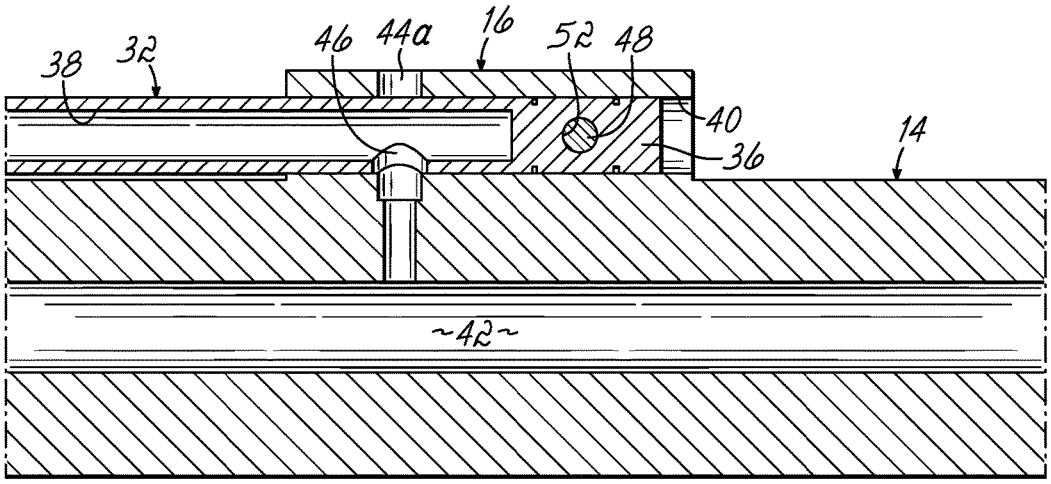
FIG. 2 is a cross-sectional view of the integral gas block and barrel with gas tube assembled as in FIG. 1 and along line 2-2 of FIG. 1 thereof.
Figure 3:
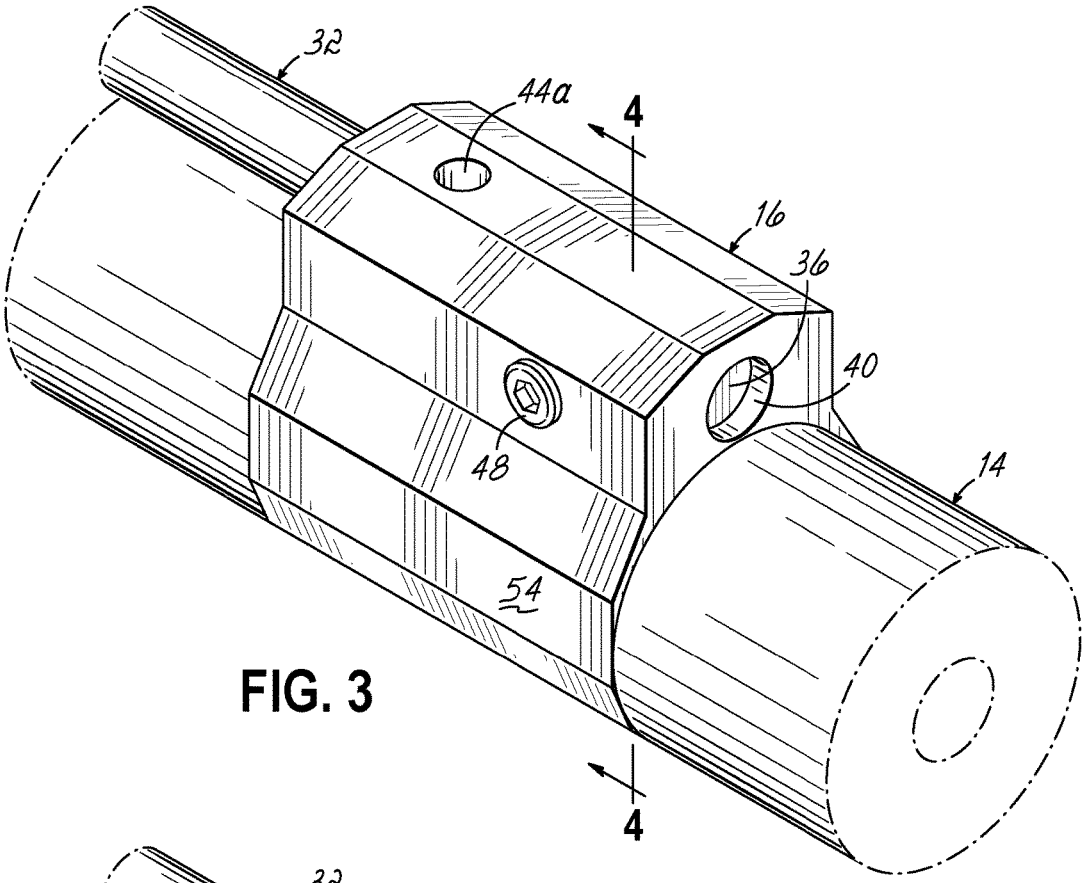
FIG. 3 is an isometric view of the integral bas block area of FIGS. 1 and 2 and showing the tube positioning screw.

As perhaps most clearly shown in FIGS. 2 and 3, block 16 has an integral, tube receiving bore 40 therein. Bore 40 is generally parallel to bore 42 of barrel 14 (FIG. 2). Gas tube 32 is inserted into bore 40 for operative communication with bore 42.

In FIG. 2, a gas passage 44 is provided in barrel 14, block 16, transverse to barrel bore 42, bore 40 in monobloc 16 and tube 32, where an opening 46 in tube 32 communicates gas passage 38 with passage 44 at bore 24. In use, gas at pressure in bore 42 (and after bullet passage) passes through passage 44, opening 46 and passage 38 rearwardly to receiver 12. For manufacture, passage 44 may be drilled through block 16 as shown in FIGS. 2-4 at bore 44*a*, for example.

Figure 4:
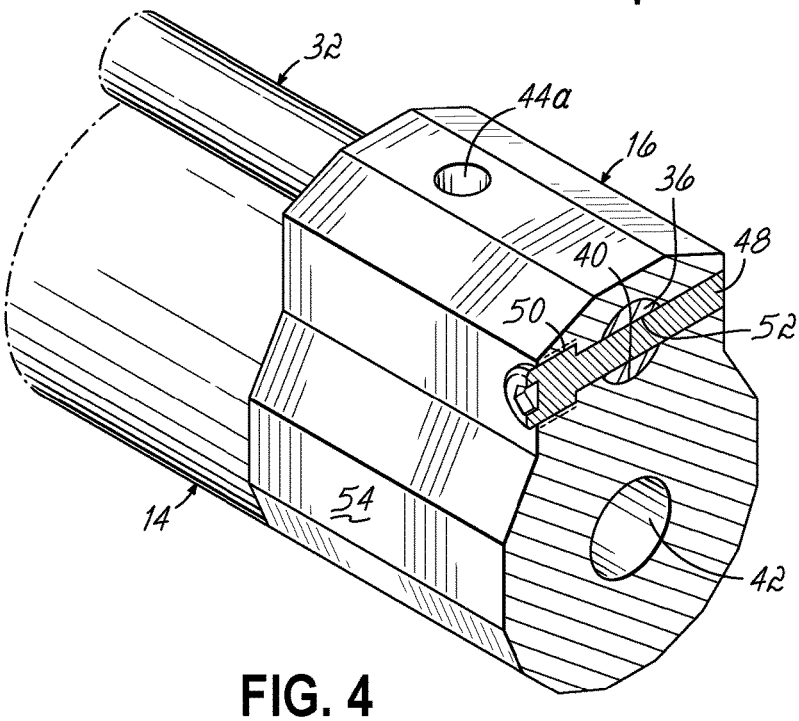
FIG. 4 is an isometric view in partial cross-section taken along line 4-4 of FIG. 3 and further illustrating the gas tube positioning pin.

From FIGS. 2-4 it will be appreciated that gas tube positioning pin 48 extends through block 16 and across the closed end 36 of tube 32. Pin 48 is threaded at 50 for securing pin 48 in block 16 and tube 32 in alignment in block 16. Pin 48 can be inserted in block 16 through tube 32 only when tube 32 is properly aligned in gas block bore 40 so its opening 46 is indexed with passage 44 in block 16.

To this end, pin receiving hole 52 is provided in tube 32 transversely and at 90° extension with respect to opening 46. Only when tube 52 is rotated to align opening 46 with gas passage 44 can pin 48 be inserted across tube 32 and block 16 as shown.

As shown in FIGS. 1 and 3-6, the outer surface 54 of barrel 14 at block 16 is flat sided, or may be rounded as desired.

Figure 5:
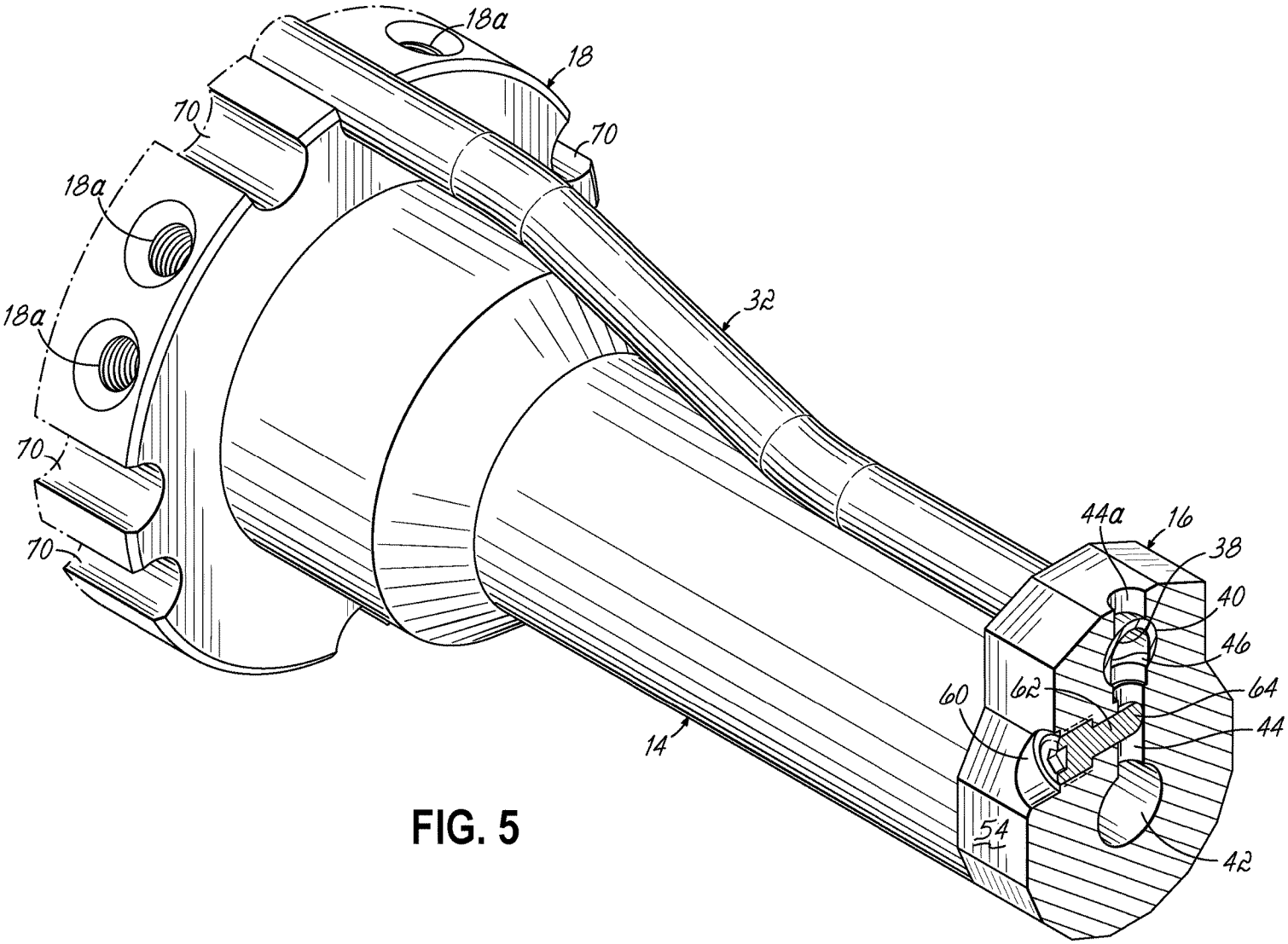
FIG. 5 is a cross-sectional view similar to FIG. 4 showing the integral gas block rearwardly of the gas tube positioning pin and further illustrating the invention with an optional gas valve or adjusting screw.

An optional feature of the invention is illustrated in FIG. 5 (like parts to the foregoing bearing like numbers). In this option, a further transverse bore 60 is provided in block 16, and a gas valve or gas adjusting screw 62 is threaded therein. Only a portion of block 16 is shown for clarity. Screw 62 has a valve end 64 extending into passage 44 for adjusting the effective flow area of passage 44 to adjust the gas flowing through opening 46 to passage 38 of tube 32. The gas impulse thus transmitted to receiver 12 for cycling the firearm can be thus be adjusted to accommodate operating pressure variation as might be required for certain muzzle devices as noted herein.

Alternatively, a gas adjusting screw could be inserted from above through bore 44*a* and an additional opening in tube 32 to seat at opening 46.

It will be appreciated that block 16 of barrel 14, being integral therewith, can be forward with only a very low extension above the normal outside diameter of barrel 14. This allows bore 40 therein to be held very closely to barrel 14, resulting in a very close final spacing of tube 32 to barrel 14.

Perhaps more significantly, this integral block structure extends only minimally above barrel 14 and nut 18 can easily be slipped over block 16 as it is positioned in assembly a the rear end of barrel 14 to secure the barrel to receiver 12. This construction has a major impact and presents significant improvement over prior assemblies where the barrel nut must be slipped over the barrel before the gas block and any muzzle devices are applied.

Such prior structures thus require an assembly process where the later-added gas block must be applied only after barrel nut passage and typically after the barrel nut is rotated to secure the barrel to the receiver. This prior process thus typically requires appropriate fixtures and tools to hold the barrel, and/or receiver for gas block alignment, and then against torquing as the prior block positioning pin is driven through the block and across the barrel. This is significant then, not only in the prior assembly process, but in later field repair or replacement of the gas tube.

In the invention, since the gas block is integral with the barrel, all passages therein are preformed as the barrel is formed. There is no later alignment of a separately provided gas block, no receiver or barrel holding fixtures are necessary for that alignment, and no torquing of the barrel respecting the gas block or receiver when any driven block position pin is applied.

Figure 6:
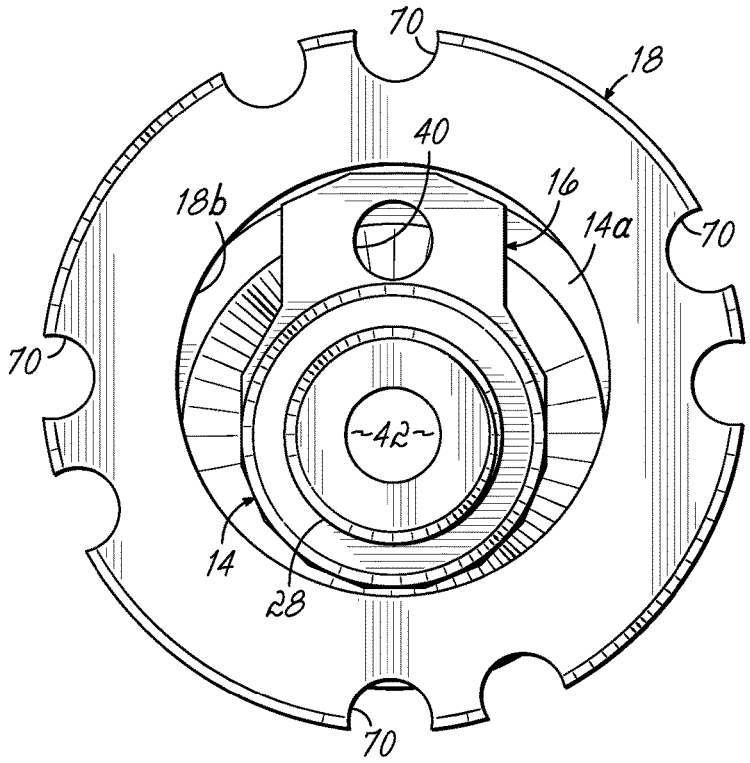
FIG. 6 is an end view of the barrel nut as it passes over the barrel and integral gas block during assembly.

In this regard, it will appreciated that nut 18 has an internal diameter or opening large enough to permit its movement over barrel 14 and block 16, such as illustrated in FIG. 6. In this FIG. 6, nut 18 is offset as it passes over block 16 of barrel 14. Internal diameter surface 18*b* is sufficient to permit nut 18 to pass over the outer portions of integral gas block 16 as illustrated. Rearwardly of the gas block 16 as in FIG. 6, the nut 18 is concentrically oriented to engage barrel flange 14*a* and hold the barrel in place on the receiver 12.

It will be appreciated that nut 18 is provided with a plurality of circumferentially spaced slots 70 to accommodate close passage of gas tube 32 at a variety of angular positions to accommodate desire torque of nut 18 holding barrel 14 to receiver 12.

It will be appreciated that bore 40 in gas block 16 is parallel to barrel bore 42 as shown in FIGS. 2, 3, 4, 5 and 6. Moreover, bore 40 in gas block 16 is parallel to and radially spaced from barrel bore 42. It will also be appreciated that as shown in the drawings at FIGS. 1, 5 and 6, the enlarged rear end portion of the barrel 14 has a radial extent having an outer diameter which is radially outside a portion of bore 40 of gas block 16.

Figure 7:
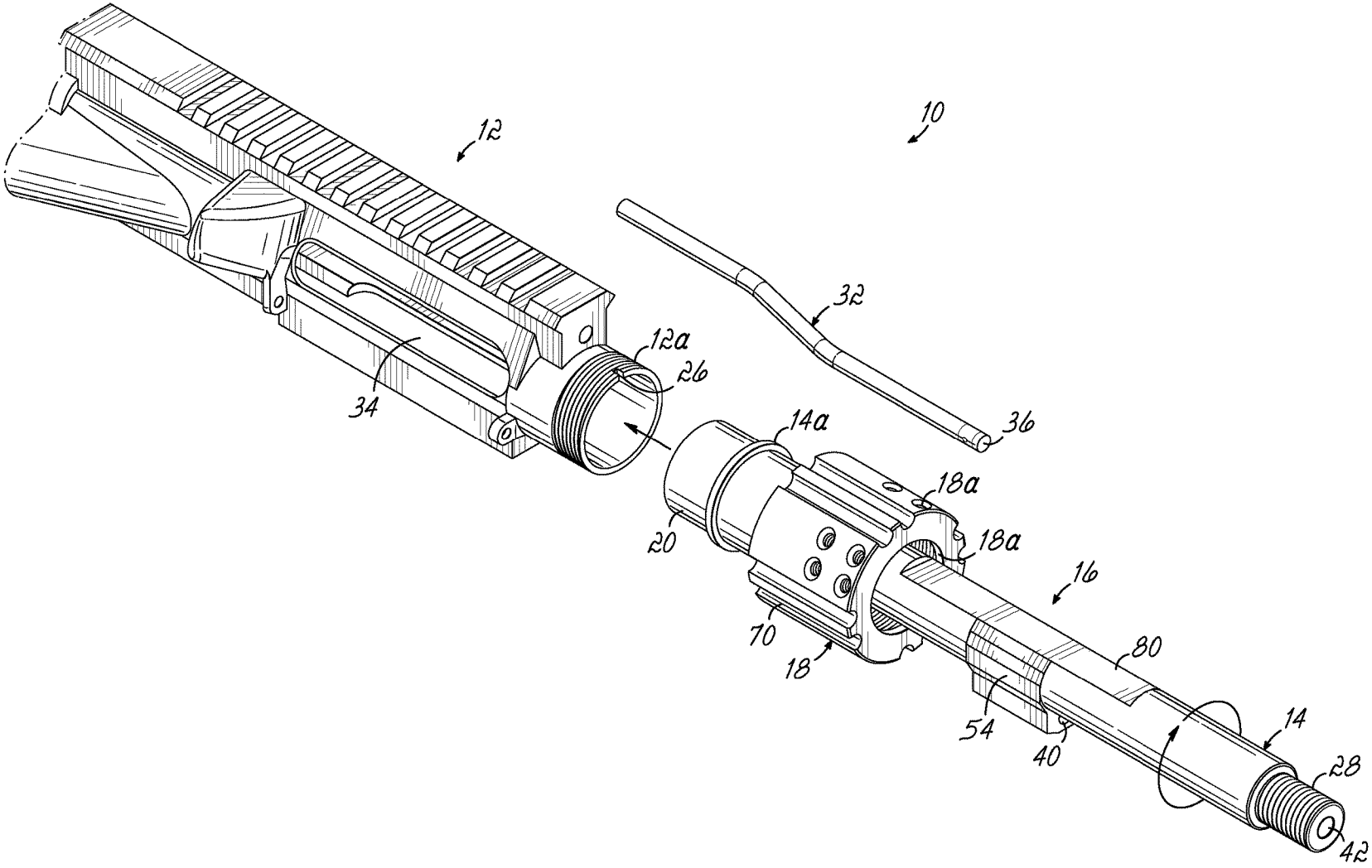
FIG. 7 is an isometric view of a portion of a firearm according to the invention in disassembled form with an optional barrel relief on the opposite side of the integral gas block to accommodate passage of a barrel nut.

In an alternative embodiment, as illustrated in FIG. 7, like parts of the previous description bear the same numbers. In FIG. 7, the barrel is rotated for clarity. Here, a further relief 80 is provided in barrel 14, under and preferably along and beyond the extent of integral gas block 16 as shown. In this regard, such relief in the area of block 16, allows further clearance for nut 18 over the block 16 as it is moved along that portion of barrel 14 during assembly. The circular arrow at the right end of the barrel proximate the muzzle illustrates the barrel is rotated 180° in use, and as shown in FIG. 8, for example.

From this disclosure, it will be appreciated the invention provides not only improved structure and assembly process but has the advantage of greatly simplifying and speeding filed expedient gas tube replacement.

In prior AR-platform firearms, that construction complicated and slowed gas tube replacement, making that process unwieldy, requiring fixtures, armorer's tools and significant time.

The invention however greatly simplifies gas tube replacement. When the gas tube must be replaced, the receiver bolt is retracted and held rearwardly. The threaded gas tube positioning pin is unscrewed, freeing the tube. It is moved rearwardly, out of bore 40 of block 16, and then forwardly, clearing receiver 12. A new gas tube is inserted into the receiver, rotated as necessary and slid forwardly into bore 40. Pin 48 is then inserted, orienting the tube and opening 46 to bore 44. The receiver bolt is closed, hand guards replaced and the firearm readied for action.

This can be accomplished, according to the invention, in seconds, and requiring only a single allen-type wrench for pin 48. No pin must be driven out or in, the barrel nut is not reset or torqued, as with prior structures, no barrel or receiver fixtures are required, and the firearm with new gas tube is quickly back in action. Moreover, while the invention accommodates larger diameter barrels and muzzle-end devices, the provision of barrels with integral gas blocks provides stiffer barrels with improved harmonic strength parameters for improved accuracy.

It will be appreciated that replacement of a driven piston in a piston-type gas operated firearm can be similarly and easily assembled or replaced.

What is claimed is:

1. A gas operated firearm comprising a receiver having an action therein with a reciprocating bolt carrier therein;

a barrel with a first bore therein for passage of a projectile;

a gas block formed integrally with said barrel together therewith as one monolithic same piece;

said barrel and said gas block being integral in that they are fabricated from a single, unitary, monolithic material;

said gas block having an outer periphery disposed radially outwardly of outer surfaces of said barrel;

a second bore extending in said gas block and perpendicularly therethrough into operable communication with said first bore in said barrel;

a third bore in said gas block operatively communicating with said second bore and disposed perpendicularly thereto;

said integral gas block formed with said barrel as one piece between forward and rearward portions of said barrel, each of said forward and rearward portions of said barrel having said outer surfaces extending radially from said barrel a distance less than the outer periphery of said gas block;

a gas tube operably communicating with said second bore in said gas block and extending therefrom in said third bore and rearwardly beyond said rearward portion of said barrel for passing gas directly to and for impingement on said bolt carrier in said firearm;

said gas tube disposed alongside but outside said barrel.

2. A firearm as in claim 1 wherein said gas block extends outwardly from said barrel on only one side of said barrel.

3. A firearm as in claim 2 wherein said barrel has a rear end proximate said rearward portion of said barrel and with an outer periphery extending radially outwardly beyond said outer periphery of said gas block.

4. A firearm as in claim 3 further including a barrel nut engaging said barrel, extending rearwardly therefrom and holding a rear end of said barrel on said receiver.

5. A firearm as in claim 4 wherein said barrel nut has an inner periphery greater than the outer periphery of said gas block, and said barrel nut being slidable over said gas block.

6. A firearm as in claim 5 wherein said inner periphery of said barrel nut is less than an outer periphery of said rear end of said barrel.

7. A firearm as in claim 6 further including a flange around a rear end of said barrel, said barrel nut engaging said flange.

8. A firearm as in claim 1 wherein said barrel further comprises a monolithic muzzle end apparatus having an outer periphery no greater than that of said gas block.

9. A firearm as in claim 1 wherein said barrel has a relieved portion in a position in said barrel on a side of said barrel spaced from and opposite said integral gas block.

10. A firearm as in claim 1 further including a barrel retaining nut having internal dimensions permitting said nut to be passed along said barrel and over said integral gas block.

11. A firearm as in claim 1 wherein said barrel has an integrally formed muzzle-end apparatus thereon, and further including a barrel nut slidable thereover onto and along said barrel.

12. A firearm as in claim 1, wherein said barrel has a rear end, said rear end having an enlarged annular portion with an outside diameter extending radially beyond a radial position of a portion of said third bore in said gas block.

13. A barrel as in claim 1 wherein said barrel has dimensions for fitting into an AR-15 rifle platform.

14. A method for making a one piece barrel for a firearm from a single piece of material including the steps of:

forming from said single piece of material a barrel together with a gas block having an outer periphery and as a monolithic, one piece part of said one piece barrel, said barrel having barrel portions on each side of said gas block and of lesser outer diameter than the extension of said outer periphery of said gas block outwardly from said barrel portions, forming a transverse bore into said gas block in operative communication with and perpendicular to a rifled bore in said barrel; and forming a longitudinal bore in said integral gas block parallel to said rifled bore in said barrel and perpendicular to said transverse bore, with said longitudinal bore in said integral gas block in operative communication with said transverse bore in said gas block.

* * * * *